US011371791B2

(12) United States Patent
Kling et al.

(10) Patent No.: US 11,371,791 B2
(45) Date of Patent: Jun. 28, 2022

(54) EXTRACTOR DEVICE FOR TORQUELESS EXTRACTION OF A CARTRIDGE CASE

(71) Applicant: Carl Walther GmbH, Ulm (DE)

(72) Inventors: Martin Andreas Kling, Waldstetten (DE); Eyck Pflaumer, Arnsberg (DE); Martin Wonisch, Arnsberg (DE)

(73) Assignee: Carl Walther GmbH, Ulm (DE)

( * ) Notice: Subject to any disclaimer, the term of this patent is extended or adjusted under 35 U.S.C. 154(b) by 0 days.

(21) Appl. No.: 17/159,466

(22) Filed: Jan. 27, 2021

(65) Prior Publication Data

US 2021/0364244 A1 Nov. 25, 2021

(30) Foreign Application Priority Data

May 19, 2020 (DE) ..... 102020113538.6

(51) Int. Cl.
*F41A 15/16* (2006.01)
*F41A 15/14* (2006.01)
*F41A 3/66* (2006.01)

(52) U.S. Cl.
CPC ..... *F41A 15/14* (2013.01); *F41A 3/66* (2013.01)

(58) Field of Classification Search
CPC ..... F41A 15/00; F41A 15/10; F41A 15/16; F41A 3/66
See application file for complete search history.

(56) References Cited

U.S. PATENT DOCUMENTS

| | | | | |
|---|---|---|---|---|
| 5,678,340 | A | 10/1997 | Moon | |
| 8,028,454 | B1 | 10/2011 | Pontillo, II | |
| 8,966,800 | B1 * | 3/2015 | Olson | F41A 15/12 42/25 |
| 2006/0185212 | A1 * | 8/2006 | Curry | F41A 15/14 42/46 |
| 2014/0196339 | A1 * | 7/2014 | Zukowski | F41A 15/00 42/25 |
| 2017/0261279 | A1 | 9/2017 | Lee | |
| 2018/0087857 | A1 * | 3/2018 | Davis | F41A 5/02 |

* cited by examiner

*Primary Examiner* — J. Woodrow Eldred
(74) *Attorney, Agent, or Firm* — Bachman & LaPointe, P.C.

(57) ABSTRACT

An extractor of a firearm is mounted rotatably about a rotation point with an extractor claw in the region of an end of the extractor near the barrel of the firearm and a contact element in the region of an end of the extractor remote from the barrel. An extractor spring biases the extractor in an end position determined when the chamber is empty. Torque-free pulling of a cartridge case is made possible in that the extractor has a protrusion mounted in a pot of the breech. The protrusion's leading edge adjoins an undersurface of the protrusion. The protrusion is mounted on a bottom surface of the pot near the barrel. The protrusion leading edge is supported on a leading edge of the pot near the barrel. The pot leading edge forms the transition from the bottom surface to a boundary wall of the pot near the barrel. The leading edge forms a rotation axis of the extractor, which allows rotation of the extractor relative to the breech.

20 Claims, 4 Drawing Sheets

EXTRACTOR DEVICE FOR TORQUELESS EXTRACTION OF A CARTRIDGE CASE

CROSS-REFERENCE TO RELATED APPLICATION

Priority is claimed of German Patent Application No. DE102020113538.6, filed May 19, 2020, and entitled "Extractor Device for Torqueless Extraction of a Cartridge Case", the disclosure of which is incorporated by reference herein in its entirety as if set forth at length.

BACKGROUND

The invention relates to an extractor device mounted in a breech (namely a breech section of a slide) with a lower part with functional elements for interaction with an upper area of a handle part of a firearm with an extractor rotatably mounted around a pivot point with an extractor claw provided in the region of an end of the extractor near the barrel of the firearm and a contact element arranged in the region of the end of the extractor remote from the barrel of the firearm and interacting with the biasing extractor spring.

Extractor devices of the type mentioned above are used in the prior art to remove the case of a fired cartridge from the cartridge chamber of the barrel prior to inserting a new cartridge. The known extractor devices, however, have the disadvantage that the process of extracting a cartridge case is associated with a spring-loaded torque of the extractor, whereby an increased exertion of force is required when pulling the breech by hand.

SUMMARY

The object of the invention is therefore to create an extractor device in which a process of extracting a cartridge case is not associated with any spring-loaded torque of the extractor, in order to minimize the exertion of force when pulling the breech by hand.

For an extractor device of the aforementioned type, this object is achieved according to the invention in that the extractor has a protrusion mounted in a pot of the breech, wherein a leading edge of the protrusion adjacent to an undersurface of the protrusion and mounted on a bottom surface of the pot is supported on a leading edge of the pot near the barrel and forming the transition from the bottom surface to a boundary wall of the pot close to the barrel and forms a rotation axis of the extractor, which allows a rotation of the extractor relative to the breech.

Preferred embodiments of the invention are the subject matter of the subordinate claims, the elements of which act in the sense of a further improvement of the approach to achieving the object underlying the invention.

In the case of the extractor device according to the invention, by means of the combination of features, wherein the extractor has a protrusion mounted in a pot of the breech, wherein a leading edge of the protrusion adjacent to an undersurface of the protrusion and mounted on a bottom surface of the pot is supported on a leading edge of the pot near the barrel and forming the transition from the bottom surface to a boundary wall of the pot close to the barrel and forms a rotation axis of the extractor, it is achieved that a process of extracting a cartridge case with no spring-loaded torque of the extractor is possible, and thus the exertion of force when pulling the breech by hand is minimized.

In the extractor device according to the invention, the depth of the pot and thus the position of the axis of rotation of the extractor within the breech is dimensioned such that pulling a cartridge case in the aftermath of firing a shot is carried out by means of the extractor claw as a rotation-free linear movement.

In an equivalent manner, the depth of the pot is dimensioned such that, in a basic position of the extractor determined by the extractor claw contacting the edge of a cartridge located in the barrel, both the axis of rotation of the extractor and the extractor claw are arranged at the same distance from the breech center line, which is aligned collinearly with the longitudinal axis of the barrel.

The leading edge of the protrusion is preferably formed on a first cam which is formed in the region of an end of the protrusion near the barrel.

According to a further preferred embodiment of the extractor device according to the invention, the undersurface of the protrusion is of concave form, wherein the first cam formed in the region of the protrusion end near the barrel is opposite a second cam formed in the region of the protrusion end remote from the barrel.

The undersurface of the protrusion is preferably designed in such a way that, in a basic position of the extractor predetermined by the extractor claw contacting the edge of a cartridge in the barrel, the second cam is arranged at a predetermined distance from the bottom surface of the pot to enable the extractor claw to swing forward in connection with a rotation of the extractor about its axis of rotation when a cartridge edge of a cartridge located in the cartridge chamber of the barrel slides over.

According to a further preferred embodiment of the extractor device according to the invention, a width of the pot is dimensioned to allow a free rotation of the second cam inside the pot around the axis of rotation of the extractor which is caused by a pretension on the extractor spring or which is forced against the force of the extractor spring.

The extractor is preferably provided with a vertical bore in a hand-held weapon, through which a vertically aligned retaining pin is guided which is vertically movable in the breech.

According to an important preferred embodiment of the extractor device according to the invention, the bore is designed as a curved elongated hole, the curvature of which is dimensioned to allow a displacement of the breech relative to the retaining pin during rotation of the extractor around its axis of rotation. The retaining pin is typically cylindrical and mounted in a vertically arranged hollow cylindrical bore of the breech.

Furthermore, the retaining pin is preferably provided with a groove in the region of its outer surface, in which one end of a coil spring mounted in a vertically arranged recess of the extractor engages to hold the retaining pin in a predetermined longitudinal axial vertical position within the elongated hole.

The contact element typically has a contact surface with which one end of the extractor spring is in contact to bias the extractor claw in a predetermined end position when the cartridge chamber is empty by means of rotation around the extractor rotation axis.

Following the firing of a shot, the rear face of the cartridge striking an ejector pin fixedly arranged in the handle part of the firearm in combination with a rearward movement of the breech due to the recoil pulse of the cartridge case relative to the handle part, as in the extractor devices known in the prior art, causes a release of a cartridge case from the extractor claw.

BRIEF DESCRIPTION OF THE DRAWINGS

The extractor device according to the invention is explained below on the basis of a preferred embodiment, which is shown in the figures of the drawing. In the figures.

DETAILED DESCRIPTION

Figure 1:
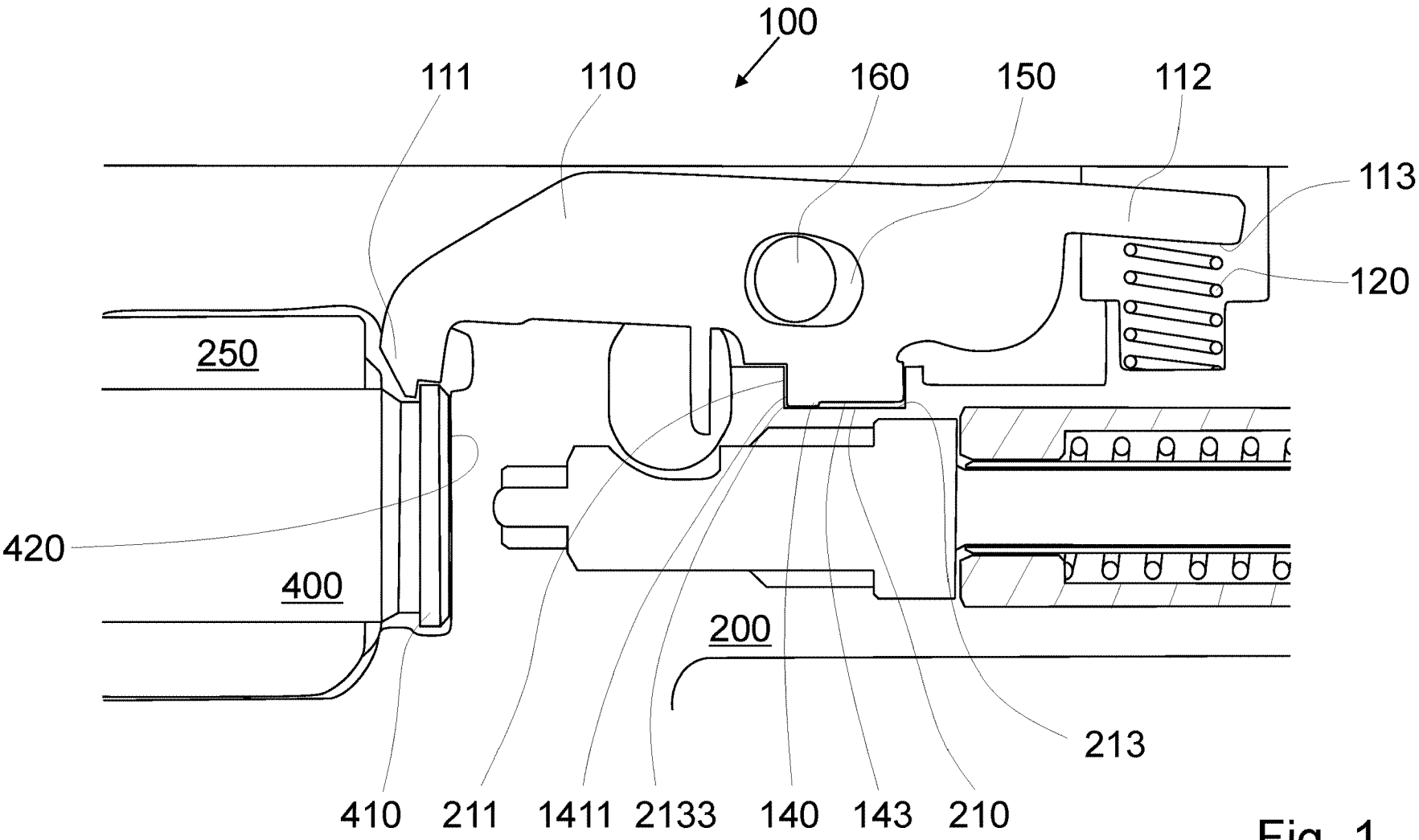
FIG. 1 shows a preferred embodiment of the extractor device according to the invention in a view from above of a partially sectioned horizontal section.

The extractor device 100 according to the invention is attached to a breech (shown as a breech section of a pistol slide) 200 with a lower part with functional elements for interaction with an upper region of a handle (frame) part 300 of a firearm and contains an extractor 110 mounted rotatably around a pivot axis with an extractor claw 111 provided in the region of an end of the extractor 110 close to the barrel 250 of the firearm and a contact element 112 arranged in the region of an end of the extractor 110 remote from the barrel 250 of the firearm, which works together with an extractor spring 120 that biases the extractor 110.

The extractor 110 has a protrusion 140 mounted in a pot or pocket 210 of the breech 200, the leading edge 1411 of which, which adjoins an undersurface 143 of the protrusion 140 and which is supported on the bottom surface 213 of the pot 210 and which is close to the barrel, is supported on a leading edge 2133, which is close to the barrel, of the pot 210 forming the transition from the bottom surface 213 to a boundary wall 211, which is close to the barrel, of the pot 210 and forms a rotation axis 1411 of the extractor 110, which allows a rotation of the extractor 110 relative to the breech 200.

The depth of the pot 210 and thus the position of the axis of rotation 1411 of the extractor 110 is dimensioned within the breech 200 so that pulling a cartridge case 400 by means of the extractor claw 111 in the aftermath of a shot being fired is carried out as rotation-free linear movement.

The depth of the pot 210 is dimensioned so that, in a basic position of the extractor 110 predetermined by the extractor claw 111 contacting the edge of a cartridge located in the barrel 250, both the axis of rotation 1411 of the extractor 110 and the extractor claw 111 are arranged at the same distance from the breech center line which is aligned collinearly with the longitudinal axis 251 of the barrel 250.

The leading edge 1411 of the protrusion 140 is formed on a first cam 141 that is formed in the region of an end of the protrusion 140 near the barrel, wherein the undersurface 143 of the protrusion 140 is of concave form, wherein a second cam 142 formed in the region of the protrusion 140 remote from the barrel is formed opposite the first cam 141 in the region of the end of the protrusion 140 near the barrel.

The undersurface 143 of the protrusion 140 is designed such that, in a basic position of the extractor 110 predetermined by the extractor claw 111 contacting the edge of a cartridge located in the barrel 250, the second cam 142 is arranged at a predetermined distance from the bottom surface 213 of the pot 210 to allow swinging forward of the extractor claw 111 in connection with a rotation of the extractor 110 around its axis of rotation 1411 in the event of sliding over by a cartridge edge 410 of a cartridge located in the cartridge chamber of the barrel 250.

The pot 210 has a width which is dimensioned to enable free rotation of the second cam 142 within the pot 210 about the axis of rotation 1411 of the extractor 110 which is caused by pretensioning of the extractor spring 120 or which is forced against the force of the extractor spring 120.

The extractor 110 is provided with a vertical hole 150 in the case of a hand-held weapon, through which a vertically aligned retaining pin 160 can be guided in the breech 200, wherein the hole 150 is designed as a curved elongated hole, the curvature of which is dimensioned to allow a displacement of the breech 200 in relation to the retaining pin 160 during rotation of the extractor 110 about its axis of rotation 1411.

The retaining pin 160 is of cylindrical form and mounted in a vertically arranged hollow cylindrical bore 220 of the breech 200. The retaining pin 160 is further provided with a groove 161 in the region of its outer surface, in which an end 171 of a spiral spring 170 mounted in a vertically arranged recess of the extractor 110 engages to hold the retaining pin 160 in a predetermined longitudinal axial vertical position within the elongated hole 150.

The contact element 112 has a contact surface 113, which one end of the extractor spring 120 adjoins to bias the extractor claw 111 in a predetermined end position in the case of an empty cartridge chamber by means of rotation around the extractor's axis of rotation 1411.

Figure 4:
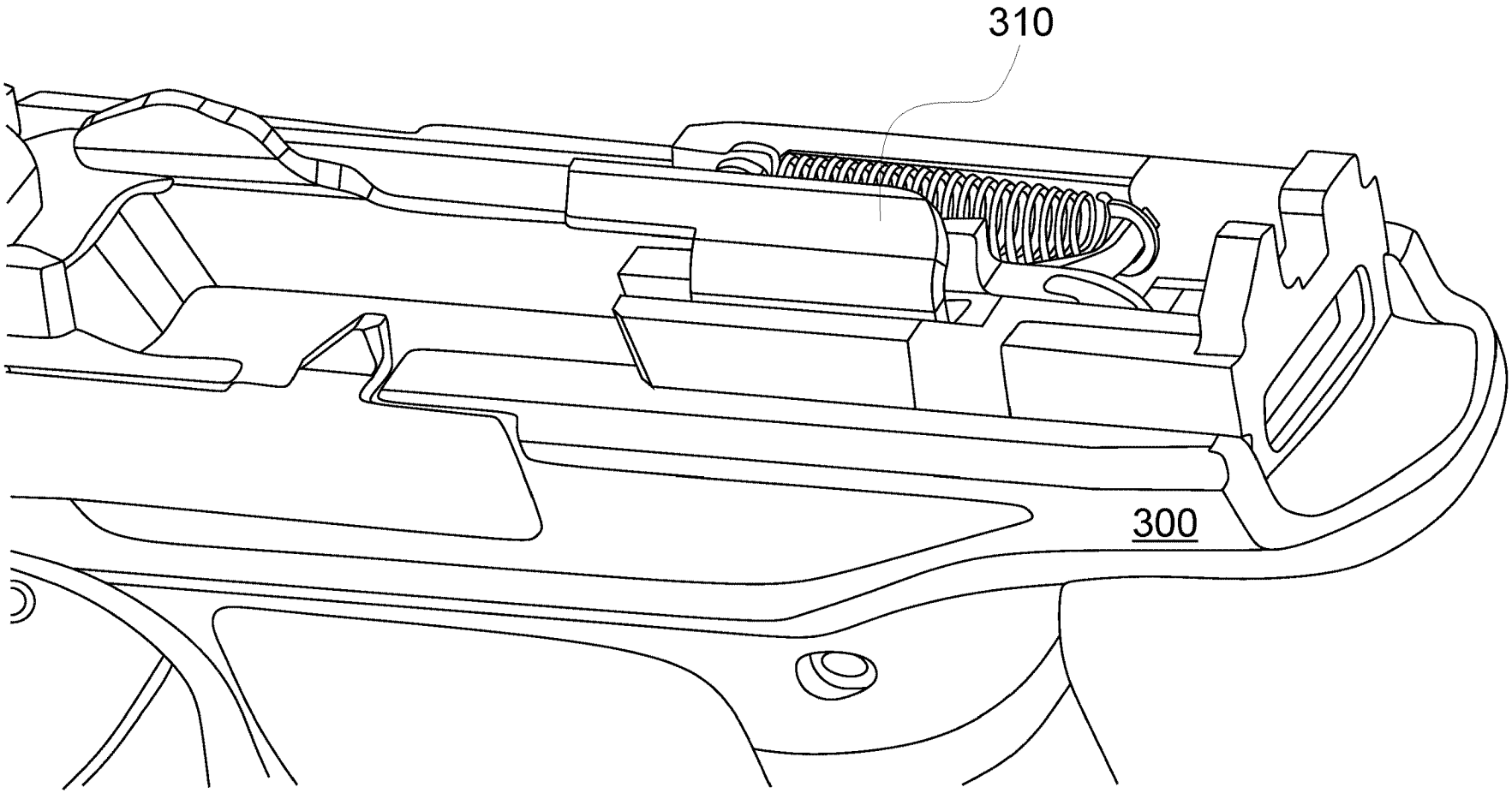
FIG. 4 shows the handle part interacting with the breech for mounting the extractor device according to the invention shown in FIGS. 1 and 2 in a view from obliquely above.

Following the firing of a shot, the rear surface 420 of the cartridge striking an ejector pin 310 shown in FIG. 4 and fixedly arranged in the handle part 300 of the firearm, in connection with a rearward movement of the breech 200 relative to the handle part 300 due to the recoil pulse of the cartridge case 400, causes the release of a cartridge case 400 from the extractor claw 111.

Figure 2:
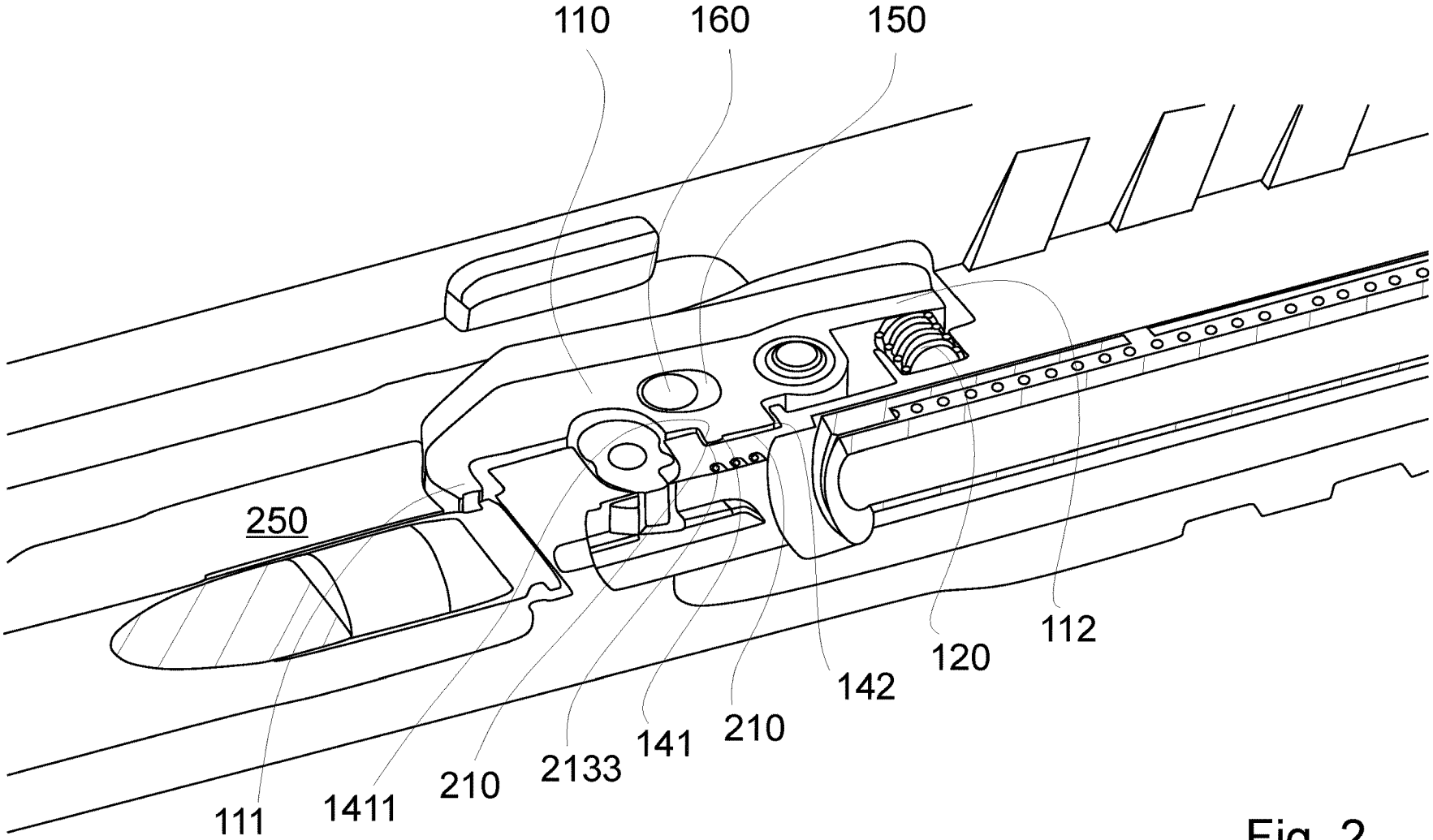
FIG. 2 shows the preferred embodiment of the extractor device according to the invention shown in FIG. 1 in a view from below of a partially sectioned horizontal section.
Figure 3:
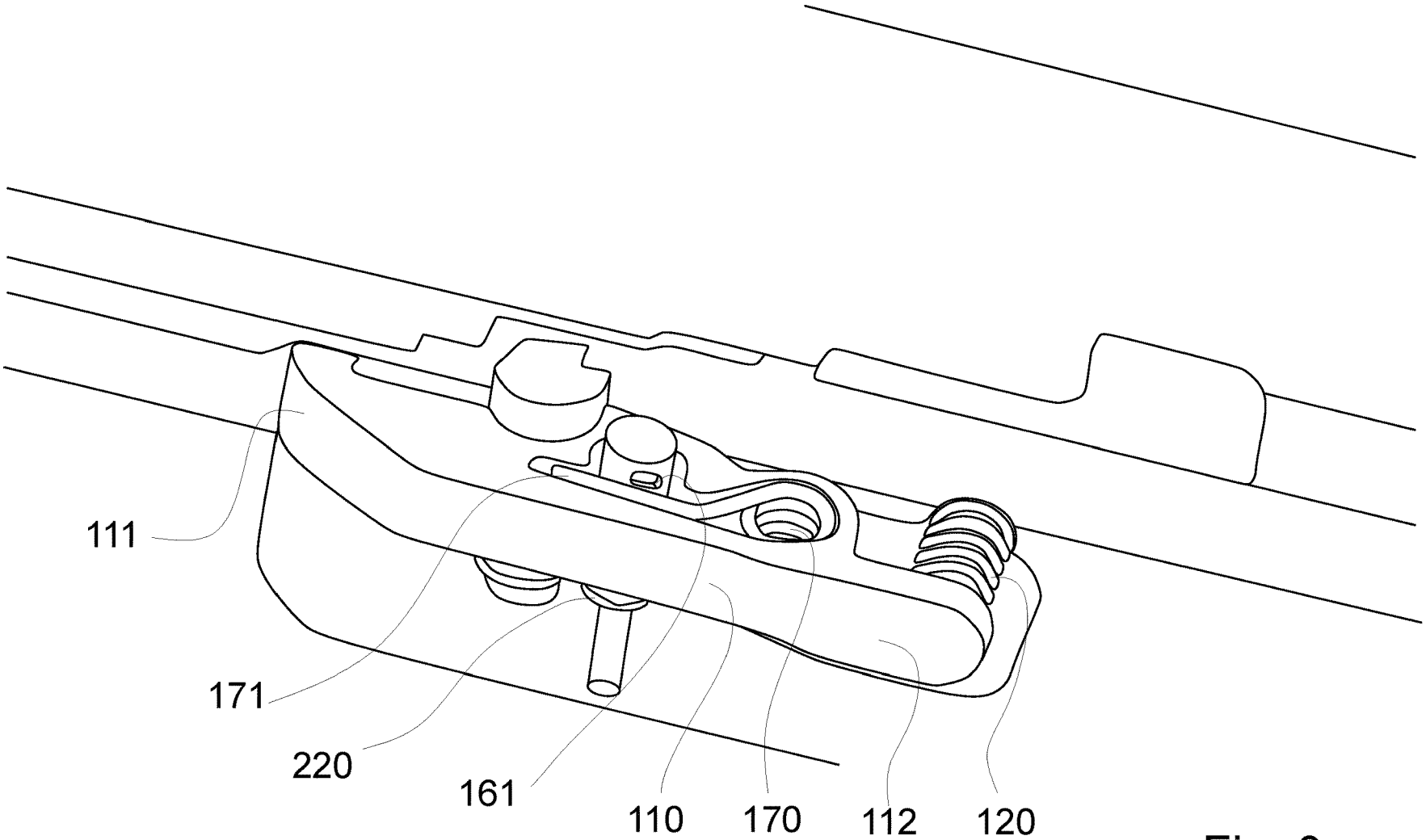
FIG. 3 shows a laterally rotated representation of the extractor device according to the invention shown in FIGS. 1 and 2 in in a view from obliquely above.

FIG. 4 shows the handle part interacting with the breech for supporting the extractor device according to the invention illustrated in FIGS. 1 to 3 in a view from obliquely above.

The exemplary embodiment of the invention explained above only serves the purpose of a better understanding of the teaching according to the invention prescribed by the claims, which as such is not restricted by the exemplary embodiment

LIST OF REFERENCE SIGNS

Below is a list of reference signs used in the drawing:

100 Extractor device
110 Extractor
111 Extractor claw
112 Contact element
113 Contact surface
120 Extractor spring
140 Protrusion
141 First cam
142 Second cam
143 Undersurface
150 Bore, elongated hole
160 Retaining pin
161 Groove
171 An end
170 Spiral spring
200 Breech
210 Pot

211 Bounding wall near the barrel
213 Inner surface, bottom surface
220 Hollow cylindrical bore
250 Barrel
251 Longitudinal axis
300 Handle part
310 Ejector pin
400 Cartridge case
410 Cartridge edge
420 Cartridge rear surface
2133 Leading edge of the pot near the barrel
1411 Leading edge of the protrusion near the barrel, axis of rotation

What is claimed is:

1. An extractor device (100) mounted in a breech (200) with a lower part with functional elements for interaction with an upper region of a handle part (300) of a firearm with an extractor (110) which is rotatably mounted around a pivot point with an extractor claw (111) provided in the region of an end of the extractor (110) near the barrel (250) of the firearm and a contact element (112) arranged in the region of an end of the extractor (110) remote from the barrel (250) of the firearm, with an extractor spring (120) biasing the extractor (110), characterized in that the extractor (110) has a protrusion (140) mounted in a pot (210) of the breech (200), the leading edge (1411) of which near the barrel resting on a bottom surface (213) of the pot (210) and adjoining an undersurface (143) of the protrusion (140) is supported on a leading edge (2133) of the pot (210) forming the transition from the bottom surface (213) of the pot (210) to a boundary wall (211) of the pot (210) near the barrel and forms an axis of rotation (1411) of the extractor (110), which allows rotation of the extractor (110) relative to the breech (200).

2. The extractor device (100) according to claim 1, characterized in that the depth of the pot (210) and thus the position of the axis of rotation (1411) of the extractor (110) within the breech (200) is dimensioned so that pulling a cartridge case (400) by means of the extractor claw (111) in the aftermath of firing a shot is carried out as a rotation-free linear movement.

3. The extractor device (100) according to claim 2, characterized in that the depth of the pot (210) is so dimensioned that, in a basic position of the extractor (110) predetermined by the extractor claw (111) contacting the edge of a cartridge case (400) in the barrel (250), both the axis of rotation (1411) of the extractor (110) and the extractor claw (111) are arranged at the same distance from the breech center line which is aligned collinearly with the longitudinal axis (251) of the barrel (250).

4. The extractor device (100) according to claim 3, characterized in that the leading edge (1411) of the protrusion (140) is formed on a first cam (141) which is formed in the region of an end of the protrusion (140) near the barrel.

5. The extractor device (100) according to claim 4, characterized in that the undersurface (143) of the protrusion (140) is of concave form and the first cam (141) formed in the region of the end of the protrusion (140) near the barrel is opposite a second cam (142) formed in the region of the end of the protrusion (140) remote from the barrel.

6. The extractor device (100) according to claim 5, characterized in that the undersurface (143) of the protrusion (140) is designed so that, in a basic position of the extractor (110) predetermined by the extractor claw (111) contacting the edge of a cartridge case (400) located in the barrel (250), the second cam (142) is arranged at a predetermined distance from the bottom surface (213) of the pot (210) to enable swinging forward of the extractor claw (111) in connection with a rotation of the extractor (110) about its axis of rotation (1411) in the event of sliding over by a cartridge edge (410) of a cartridge case (400) located in the cartridge chamber of the barrel (250).

7. The extractor device (100) according to claim 6, characterized in that a width of the pot (210) is dimensioned to enable free rotation of the second cam (142) within the pot (210) about the axis of rotation (1411) of the extractor (110) which is caused by pretensioning of the extractor spring (120) or which is forced against the force of the extractor spring (120).

8. The extractor device (100) according to claim 7, characterized in that the extractor (110) is provided with a vertical bore (150) through which a vertically aligned retaining pin (160) which is movable in the breech (200) is guided.

9. The extractor device (100) according to claim 8, characterized in that the bore (150) is designed as a curved elongated hole, the curvature of which is dimensioned to allow a displacement of the breech (200) relative to the retaining pin (160) during rotation of the extractor (110) about its axis of rotation (1411).

10. The extractor device (100) according to claim 9, characterized in that the retaining pin (160) is of cylindrical form and is mounted in a vertically arranged hollow cylindrical bore (220) of the breech (200).

11. The extractor device (100) according to claim 10, characterized in that the retaining pin (160) is provided with a groove (161) in the area of its outer surface in which one end (171) of a spiral spring (170) mounted in a vertically arranged recess of the extractor (110) engages to hold the retainer pin (160) in a predetermined longitudinal axial vertical position within the elongated hole (150).

12. The extractor device (100) according to claim 11, characterized in that the contact element (112) has a contact surface (113) which one end 121 of the extractor spring (120) adjoins to bias the extractor claw (111) in a predetermined end position in the case of an empty cartridge chamber by rotation about the extractor rotation axis (1411).

13. The extractor device (100) according to claim 12, characterized in that in the aftermath of firing a shot, the cartridge rear surface (420) striking an ejector pin (310) fixedly arranged in the handle part (300) of the firearm in connection with a rearward movement of the breech (200) relative to the handle part (300) caused by the recoil pulse of the cartridge case (400) causes the release of a cartridge case (400) from the extractor claw (111).

14. The extractor device (100) according to claim 1, characterized in that the depth of the pot (210) is so dimensioned that, in a basic position of the extractor (110) predetermined by the extractor claw (111) contacting the edge of a cartridge case (400) in the barrel (250), both the axis of rotation (1411) of the extractor (110) and the extractor claw (111) are arranged at the same distance from the breech center line which is aligned collinearly with the longitudinal axis (251) of the barrel (250).

15. The extractor device (100) according to claim 1, characterized in that the leading edge (1411) of the protrusion (140) is formed on a first cam (141) which is formed in the region of an end of the protrusion (140) near the barrel.

16. The extractor device (100) according to claim 15, characterized in that the undersurface (143) of the protrusion (140) is of concave form and the first cam (141) formed in the region of the end of the protrusion (140) near the barrel is opposite a second cam (142) formed in the region of the end of the protrusion (140) remote from the barrel.

17. The extractor device (100) according to claim 16, characterized in that the undersurface (143) of the protrusion (140) is designed so that, in a basic position of the extractor (110) predetermined by the extractor claw (111) contacting the edge of a cartridge case (400) located in the barrel (250), the second cam (142) is arranged at a predetermined distance from the bottom surface (213) of the pot (210) to enable swinging forward of the extractor claw (111) in connection with a rotation of the extractor (110) about its axis of rotation (1411) in the event of sliding over by a cartridge edge (410) of a cartridge case (400) located in the cartridge chamber of the barrel (250).

18. The extractor device (100) according to claim 16, characterized in that a width of the pot (210) is dimensioned to enable free rotation of the second cam (142) within the pot (210) about the axis of rotation (1411) of the extractor (110) which is caused by pretensioning of the extractor spring (120) or which is forced against the force of the extractor spring (120).

19. The extractor device (100) according to claim 1, characterized in that the extractor (110) is provided with a vertical bore (150) through which a vertically aligned retaining pin (160) which is movable in the breech (200) is guided.

20. A firearm comprising:

a slide having a breech section (200);

an extractor (110) mounted in the breech section and having:

an extractor claw (111) at a first end of the extractor (110) near the barrel (250) of the firearm; and a contact element (112) at a second end of the extractor (110) remote from the barrel (250) of the firearm;

an extractor spring (120) biasing the extractor to bias the extractor claw in a direction toward a longitudinal axis (151) of the barrel, wherein:

the extractor has a protrusion (140) mounted in a pocket (210) of the breech section with a surface (143) of the protrusion contacting a base (213) of the pocket;

the extractor has a curved elongate hole (150); and the breech section has a retaining pin (160) extending through the hole.

* * * * *